US007678028B1

(12) United States Patent
Gore

(10) Patent No.: US 7,678,028 B1
(45) Date of Patent: Mar. 16, 2010

(54) MARTIAL ARTS TRAINING DEVICE

(76) Inventor: Williams B. Gore, 141 Gore Trailer Rd., Whiteville, NC (US) 28472

( * ) Notice: Subject to any disclaimer, the term of this patent is extended or adjusted under 35 U.S.C. 154(b) by 0 days.

(21) Appl. No.: 11/303,086

(22) Filed: Dec. 14, 2005

(51) Int. Cl.
*A63B 69/20* (2006.01)
*A63B 69/28* (2006.01)
*A63B 69/30* (2006.01)

(52) U.S. Cl. ..... 482/89; 482/86

(58) Field of Classification Search ..... 482/83–90; D21/798; 473/441–445; 273/440.1; *A63B 69/20*
See application file for complete search history.

(56) References Cited

U.S. PATENT DOCUMENTS 903,731 A * 11/1908 Kull ..... 472/15
1,530,519 A * 3/1925 Remington ..... 473/216
2,249,309 A 7/1941 Benko
4,077,624 A 3/1978 Feaser ..... 272/76
4,572,504 A * 2/1986 DiBartolo ..... 482/83
4,662,630 A 5/1987 Dignard et al. ..... 272/76
5,046,724 A 9/1991 Sotomayer ..... 272/78
5,252,076 A 10/1993 Kelleher ..... 434/251
5,389,057 A 2/1995 Zagata, Jr. ..... 482/83
5,458,551 A * 10/1995 Shenton ..... 482/83
5,554,088 A 9/1996 Zlojutro ..... 482/83
5,665,035 A * 9/1997 Tumminia ..... 482/83
5,688,212 A * 11/1997 Walker ..... 482/83
5,800,319 A 9/1998 Choate ..... 482/83
5,863,278 A * 1/1999 Chen ..... 482/83
5,902,217 A * 5/1999 Schechner et al. ..... 482/83
6,027,435 A 2/2000 Nadorf et al. ..... 483/146
6,220,992 B1 * 4/2001 Shafik ..... 482/83
6,302,831 B1 10/2001 Henry ..... 482/83
6,432,027 B1 8/2002 Haselrig ..... 483/83
6,736,764 B1 * 5/2004 Kapustka ..... 482/83
6,743,157 B2 * 6/2004 Hackaday ..... 482/83
6,749,548 B2 * 6/2004 Hoffman ..... 482/148
6,872,171 B2 * 3/2005 Haselrig ..... 482/83
6,893,384 B2 5/2005 Triani ..... 482/83
2002/0010057 A1 * 1/2002 Bouvier ..... 482/86
2007/0087912 A1 * 4/2007 DeCologero ..... 482/86
2008/0015093 A1 * 1/2008 Helton ..... 482/83

* cited by examiner

*Primary Examiner*—Loan H Thanh
*Assistant Examiner*—Oren Ginsberg
(74) *Attorney, Agent, or Firm*—MacCord Mason PLLC

(57) ABSTRACT

A marital arts training device comprising a barrier for creating a target zone. In a preferred embodiment, the martial arts training device includes: a barrier support; at least one barrier mounted to the barrier support for creating a target zone; and a target located within the target zone.

27 Claims, 8 Drawing Sheets

MARTIAL ARTS TRAINING DEVICE

BACKGROUND OF THE INVENTION (1) Field of the Invention

The present invention relates generally to martial arts training devices and, more particularly, to a training device that creates a target zone.

(2) Description of the Prior Art

Martial arts training devices are used, among other things, to help people develop a wide variety of striking skills. For example, punching bags are used to help people develop punching and kicking skills. Such bags may be useful for developing technique, however, they are typically large and thus do not facilitate the development of striking accuracy. Target bags, or smaller punching bags, may be used to help people develop the accuracy of their punches and kicks. Such punching bags and target bags typically rest on the floor at a fixed height or are suspended from above at a fixed height. Often, trainees are forced to buy multiple punching bags and target bags to practice various techniques and hone accuracy. For example, one punching bag might be used for kicking and another for punching, or multiple target bags might be used to practice kicking at different heights. The requirement for additional devices is undesirable. Further, such fixed devices are undesirable because they are static; not allowing the trainee to deviate from the positioning of the fixed targets.

One way trainees increase target variability is to use handheld targets. Handheld targets are pads or padded targets, which are held by a holder. Usually, they are smaller and are used to develop striking accuracy over a range of positions. The necessity of an additional holder, however, is undesirable because such a holder may not always be available.

While punching bags, target bags, and handheld targets are all valuable training tools, these traditional devices may require the trainee to purchase a number of bags or targets, or to train with a training partner to achieve desired results. Further, traditional devices only allow a trainee to "hit" or "miss" their target. They fail to simulate a "block" and thus similarly fail to teach the trainee how to strike through defenses.

Thus, there remains a need for a training device with at least one barrier between the trainee and the target to create a target zone while, at the same time, simulates blocking and teaches the trainee how to strike through defenses.

SUMMARY OF THE INVENTION

The present invention is directed to a marital arts training device comprising a barrier for creating a target zone.

The preferred device has adjustable barriers movably mounted to a steel barrier support capable of withstanding the rigors of martial arts training. The barriers create one or more target zones for the trainee to aim his kicks and/or punches. Ideally, the barrier support mounts to the same base that supports the target. In other embodiments, the barrier support may be mounted to the floor or a wall; or suspended from the ceiling. The barrier support may also be omitted if other means are used to support the barriers.

The invention includes at least one barrier. Preferably, the barrier mounts to the barrier support and is adjustable, allowing the user to slide the barrier up and down the barrier support to the desired location. The barrier defines a target zone and simulates blocking. Multiple barriers may also be desirable to adjust the size of the target zone or to provide multiple target zones and blocking areas. If a barrier support is not used, the barriers may attach to each other, to the target, or to another support, such as a wall.

A target is located within or behind the barrier. In the preferred embodiment, the target is a covered spring connected at one end to a portion of the barrier support extending over the base and at the other end to the base. In other embodiments the target may rest on the floor or the base or be attached to only the floor or the base. Still, in other embodiments the target may be suspended from the ceiling, from the barrier support, or from a wall.

Accordingly, one aspect of the present invention is to provide a marital arts training device comprising a barrier for creating a target zone.

Another aspect of the present invention is to provide a martial arts training device comprising: a barrier support; and at least one barrier mounted to the barrier support, thereby creating a target zone.

Still another aspect of the present invention is to provide a martial arts training device comprising: a barrier support; at least one barrier mounted to the barrier support for creating a target zone; and a target located within the target zone.

These and other aspects of the present invention will become apparent to those skilled in the art after a reading of the following description of the preferred embodiment when considered with the drawings.

DESCRIPTION OF THE PREFERRED EMBODIMENTS

Figure 1:
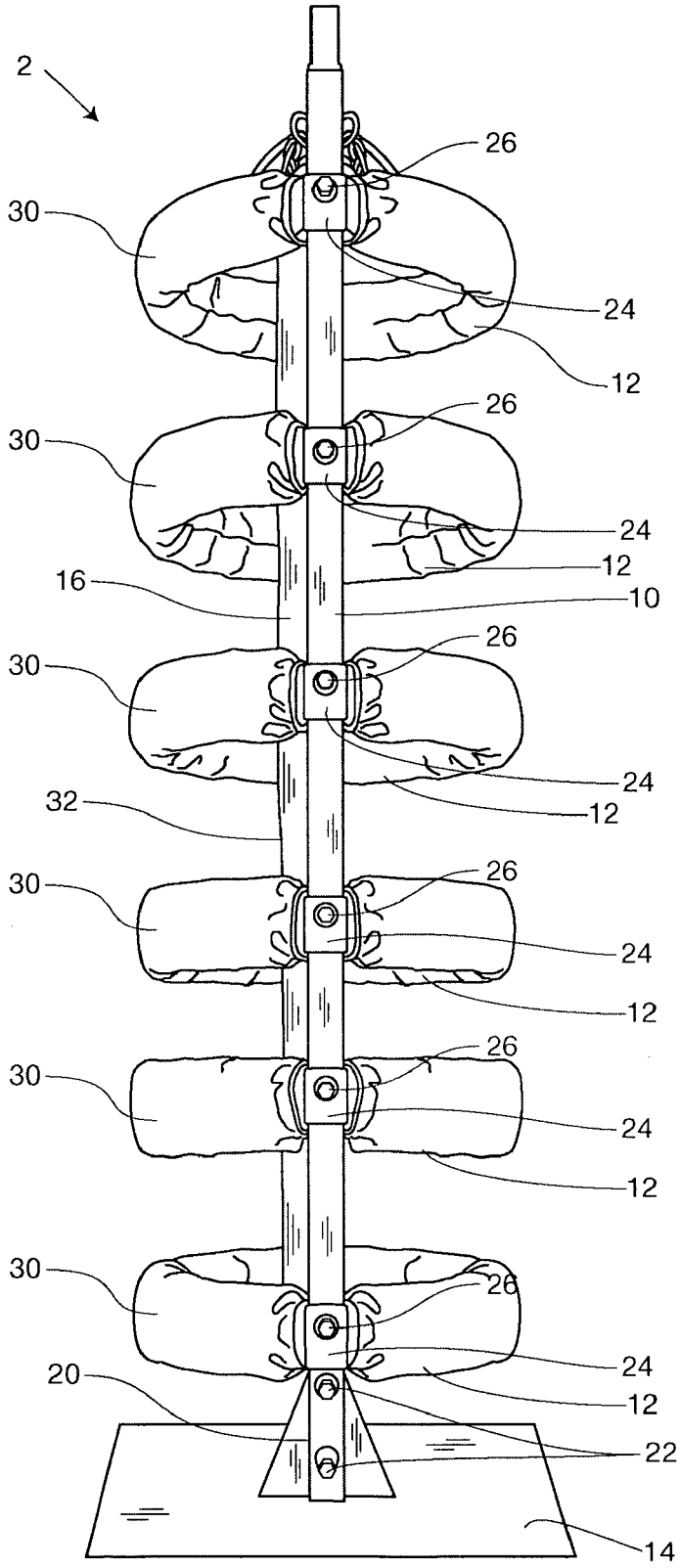
FIG. 1 is a perspective rear view of a martial arts training device constructed in accordance with one embodiment of the present invention.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, a martial arts training device, generally designated 2, is shown constructed according to the present invention. The device includes a barrier support 10, barriers 12, a base 14, and a target 16. The barrier support 10 is mounted to the base 14 at a base-mount 20 and secured with base-bolts 22.

In this embodiment, the barrier support 10 is preferably constructed of square-beam steel, which is desirable for its strength and its ability to be removably mounted to the base at the base-mount 20. Others may prefer to construct the barrier support out of another cross section or another material, such as iron pipe, lumber, plastic, cinder block, composites, or other materials capable of supporting the barriers.

While the barrier support depicted is relatively linear and continuous, anything capable of supporting or suspending a barrier, or creating space between barriers, is considered a barrier support within the scope of the present invention. For example, the barrier support may be non-linear or irregular or non-contiguous and still be within the scope of the present invention.

The base 14 is a steel plate. In this embodiment, the base 14 rests on the floor and provides adequate stability due to its size and its weight. Others may desire to use a smaller base, a larger base, or to attach the base to the floor to increase stability. Still others may desire to attach the barrier support 10 directly to the floor, wall or ceiling.

Barriers 12 attach to the barrier support 10 using barrier-attachments 24 secured by barrier-bolts 26. The barrier-attachments 24 are square receptacles adapted to receive the barrier support 10. The barrier-bolts 26 bolt into the barrier-attachments 24 and can be tightened to clamp the barriers 12 at a desired location on the barrier support 10. The barriers 12 may be adjustable up and down the barrier support 10, and may also be removable from the barrier support 10. Others may prefer to use fixed barriers 12 or barriers 12 that are not removable from the barrier support 10, all of which would be in the scope of the present invention. Those skilled in the art would also recognize that a variety of other barrier-attachments could be used to attach the barrier 12 to the barrier support 10, such as bolts attached through holes in the barrier support, quick release clamps, a rack and pinion assembly, or other means of attachment.

In FIG. 1, the barriers 12 are cylindrical and contain a barrier core (not visible) made of steel. Pad (not visible) covers the barrier core to provide shock absorption. An outer-barrier-jacket 30 covers the barrier core and the padding to increase wear-resistance and durability. Others may prefer to use another barrier shape, such as, for example, rectangular, elliptical, or frustoconical; to have the barrier 12 only partially surround the target; to have barriers 12 at different distances or angles relative to the target; or to construct the barrier 12 out of another material, such as aluminum, wood, plastic, composite or foam, all of which would be in the scope of the present invention.

The pad may be replaced with other shock absorbing substances such as dried beans, air, water, foam, sand, saw dust or similar materials, any of which, or any combination of which, is in the scope of the present invention. Similarly, numerous materials could be used to make the outer-barrier-jacket 30, such as plastic, leather, canvas, Naugahyde® vinyl coated fabrics or other similar materials, which all would be in the scope of the present invention. Others may also prefer to attach barriers 12 to each other to create a larger barrier or a barrier of varying dimensions. Still others may prefer to make the barriers pivotable around the point of attachment, in the same manner as adjustable basketball goals, so that the barriers 12 may be raised or lowered without detaching them from the barrier support 10.

Figure 3:
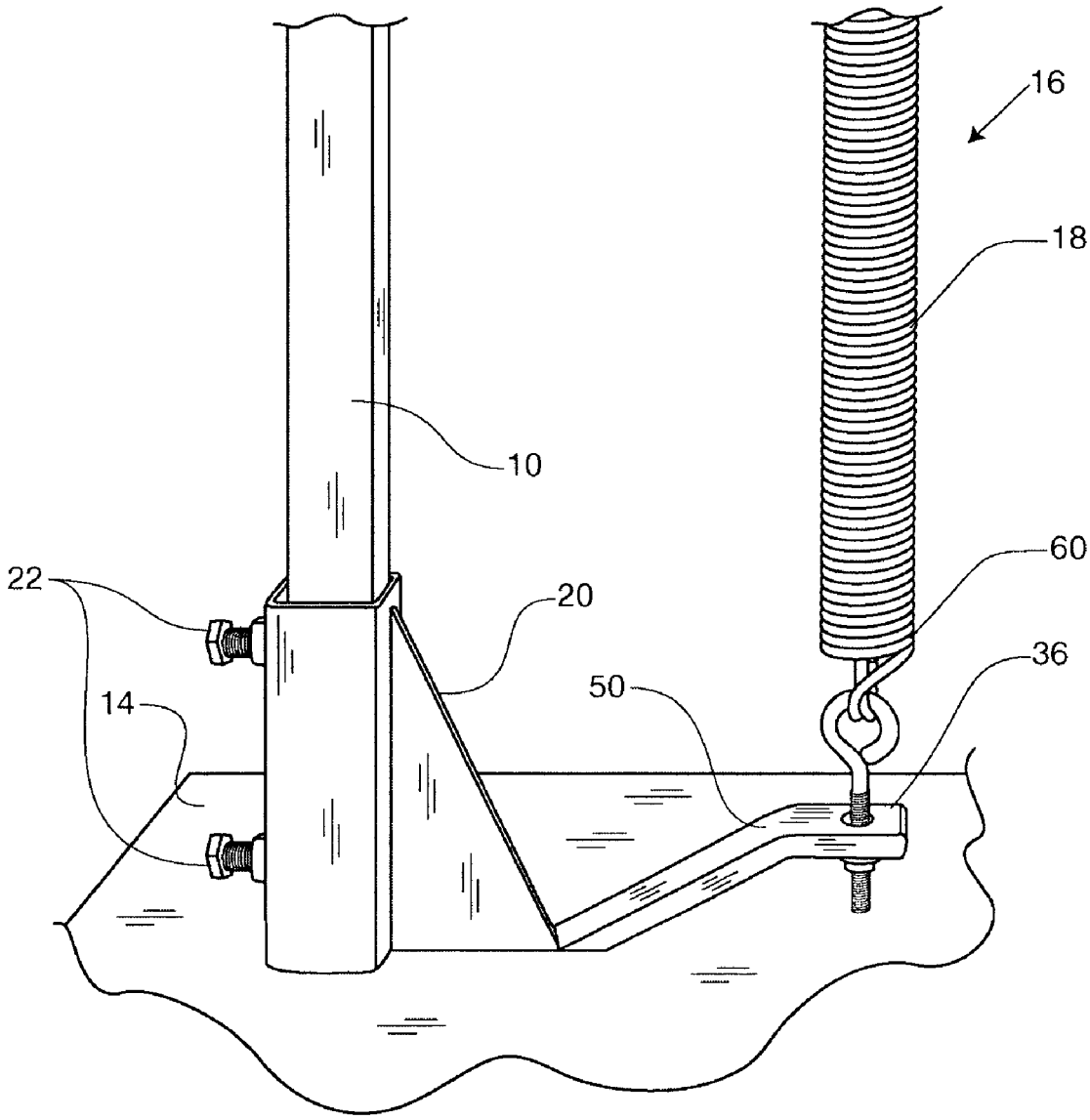
FIG. 3 is a close-up perspective of a base, a barrier support and a target of the device of FIG. 1.

As shown in FIG. 3, the target 16 of the present embodiment includes a spring 18 covered by a pad 32. The target 16 attaches to the base 14 at point 36 and attaches to the top of the barrier support 10 at point 48 (see FIG. 4). In this embodiment, a spring is desirable for its elasticity, resilience and durability, but others may prefer another elastic target, such as a target made of bungee cord or rubber tubing for example. Others may also prefer a more traditional target, such as a bag filled with sand, saw dust, foam, beans, pebbles, cloth, water, or air. Still, others may prefer more rigid targets, such as posts or pipes, for example.

Similarly, while the spring 18 is covered by a pad 32, other materials may also be used to cover the spring 18, such as foam, cloth, plastic, leather, canvas, dried beans, air, water, foam, sand, saw dust, or any other similar substance, to provide shock absorption. Further, the pad 32 may be wrapped in outer-barrier-jacket 30 made of plastic, leather, canvas, Naugahyde® vinyl coated fabrics or other similar substances used by those skilled in the art. Alternatively, the target may not be covered and/or wrapped.

Figure 2:
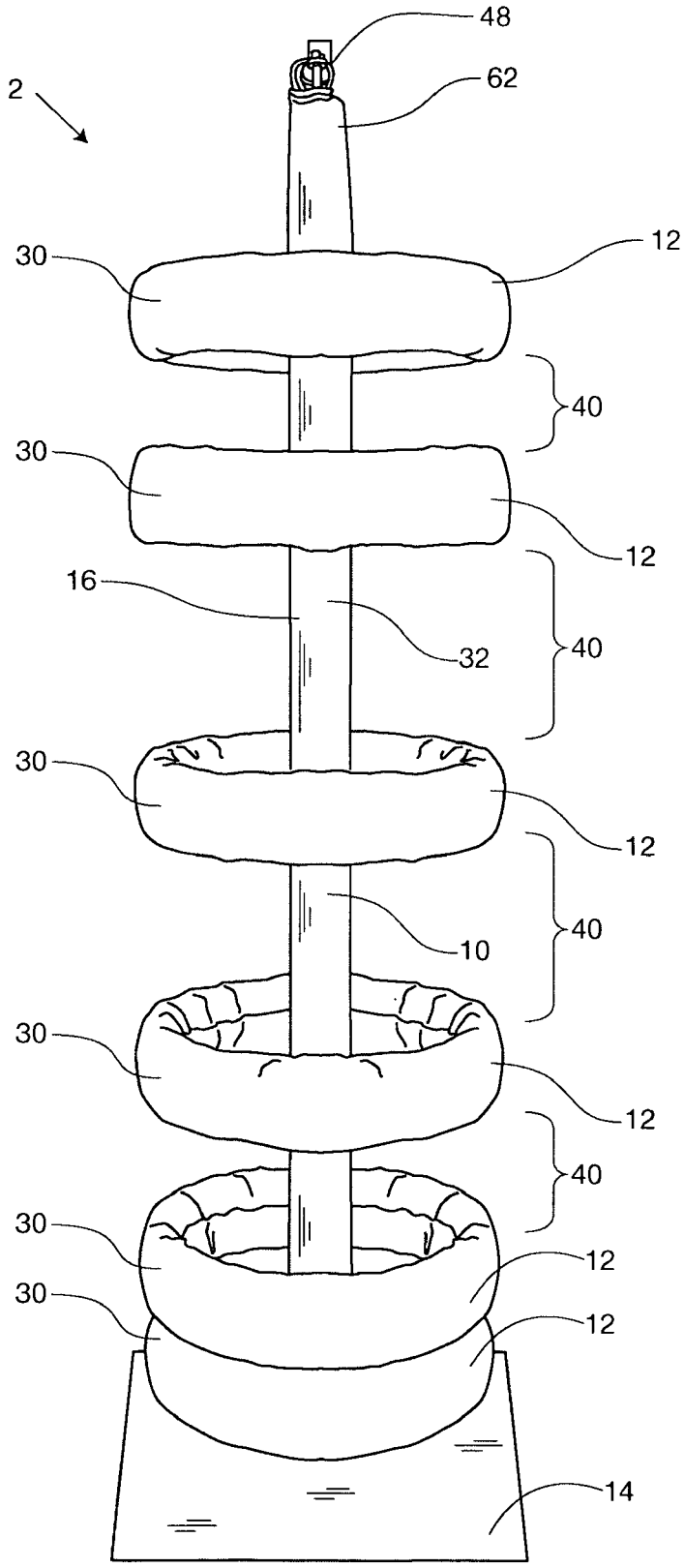
FIG. 2 is a front view of the martial arts training device of FIG. 1.

FIG. 2 shows a front view of the martial arts training device 2 shown in FIG. 1. Target zones 40 are defined by barriers 12. The target 16 is located within the target zones 40 and is designed to be punched and/or kicked by the trainee. Target zones 40 are adjustable to the desired height or width by relocating, adding, removing, or changing barriers 12.

FIG. 3 shows a close-up view of the base 14, the barrier support 10, and the target 16 of FIG. 1. The barrier support 10 is recessed into the base-mount 20 of the base 14. The barrier support 10 is clamped to the base-mount 20 with base-bolts 22. The target 16 is a spring 18 having a first end 60 (target pad 32 removed) attached to the base 14 at point 36. The drawing shows a base-arm 50 extending up from the base 14 to facilitate attachment at point 36.

Figure 4:
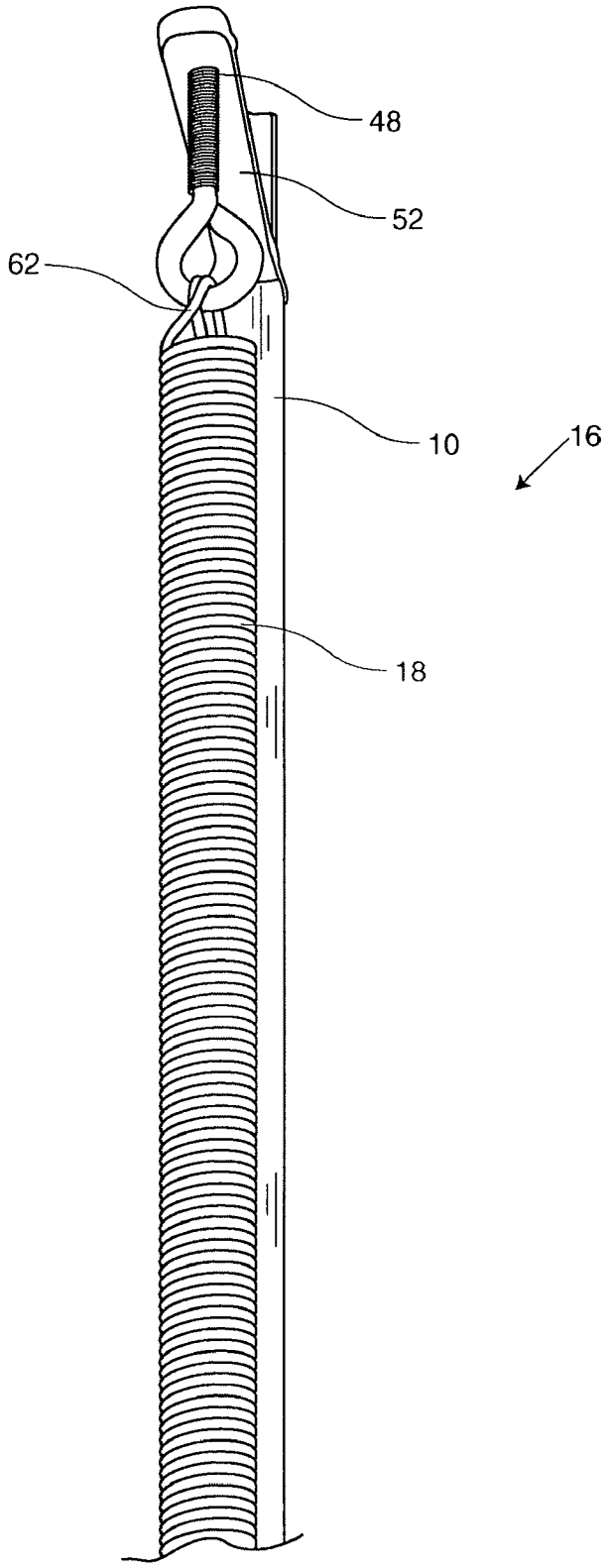
FIG. 4 is a close-up of the barrier support, the upper portion of the barrier support, and the target of the device of FIG. 1.

FIG. 4 is a close-up showing the target 16 attached to the barrier support 10. The barrier support 10 includes an extension arm 52 extending away from the barrier support 10. In this particular embodiment, the extension arm is extending over the base 14 (not visible in this Figure). The second end 62 of the target 16 attaches to the extension arm 52 of the barrier support 10 at point 48. In this embodiment, the extension arm 52 extends substantially horizontally off a substantially vertical barrier support 10

Figure 5:
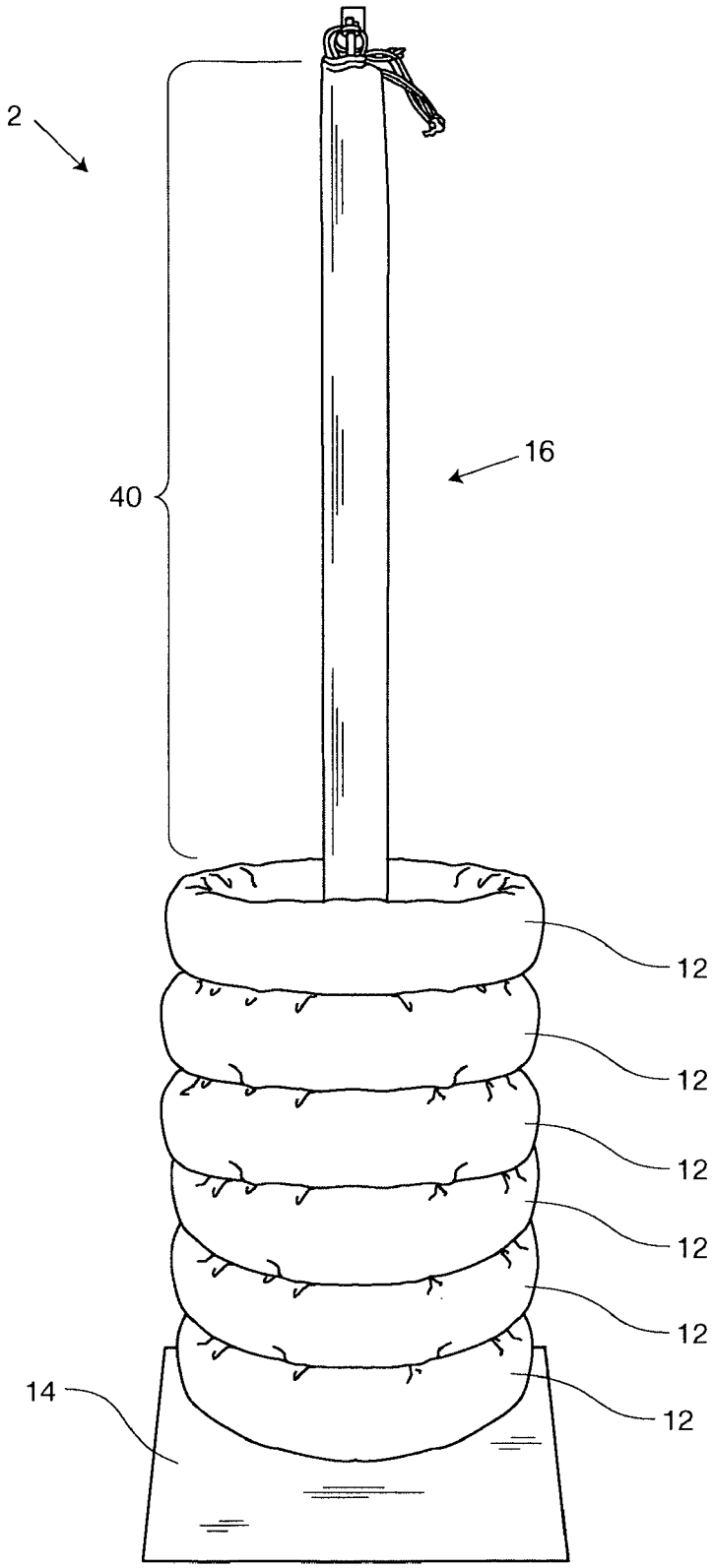
FIG. 5 is the martial arts training device as shown in FIG. 1 with a different barrier arrangement.

FIG. 5 shows another front view of the device 2 from FIG. 1 with barriers 12 adjusted on the barrier support 10 to create a different target zone 40.

Figure 6:
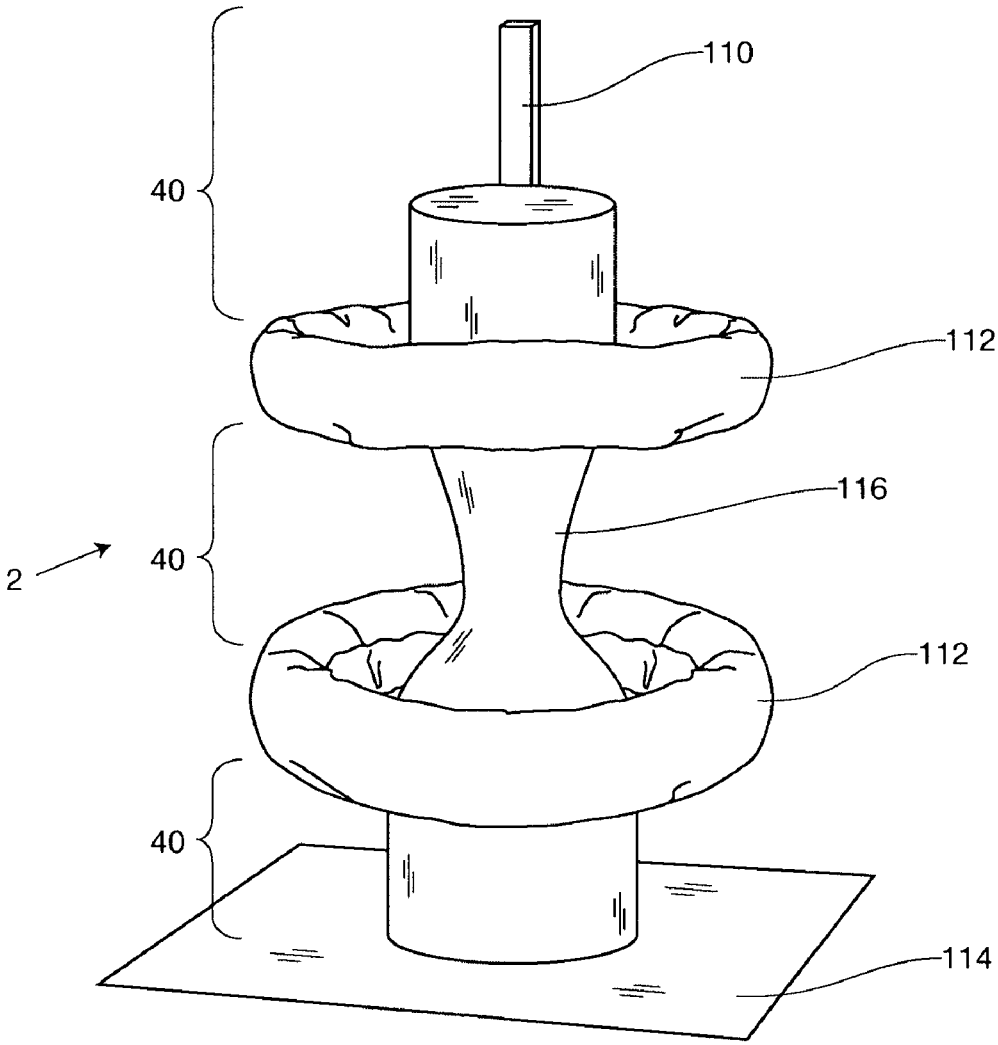
FIG. 6 is a perspective view of a martial arts training device in accordance with another embodiment of the present invention.

FIG. 6 shows a view of another embodiment of the device 2 of the present invention. The target 116 is an upright bag resting on the base 114. Such upright targets are well known in the art. The target 116 is surrounded by barriers 112 adjustably mounted on the barrier support 110 to create adjustable target zones 140.

Figure 7:
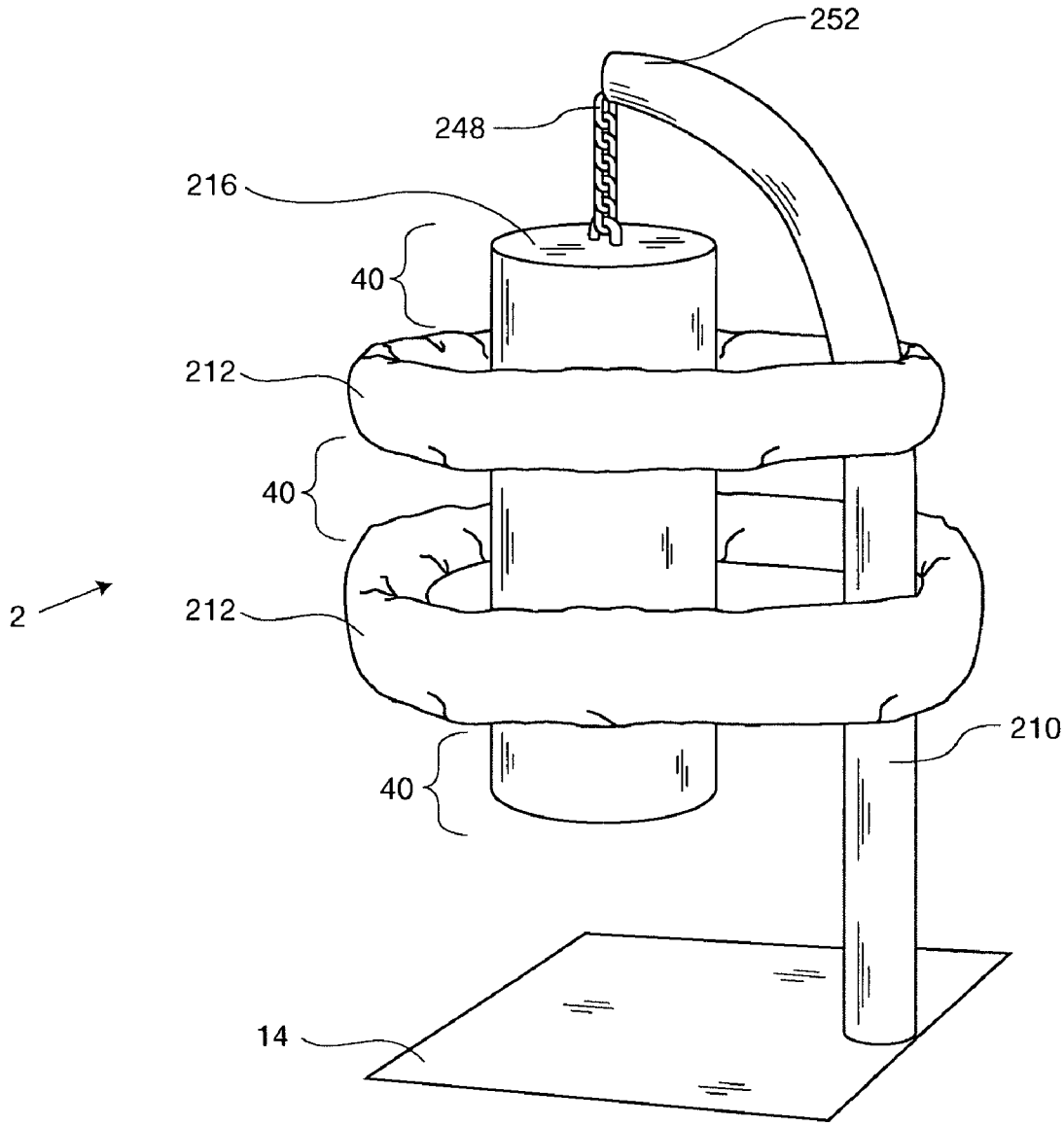
FIG. 7 is a perspective view of a martial arts training device in accordance with yet another embodiment of the present invention.

FIG. 7 shows a view of another embodiment of the device 2 of the present invention. The target is a suspension target 216 suspended from the extension arm 252 of the barrier support 210 at point 248. Such suspension targets are well known in the art. The target 216 is surrounded by barriers 212 adjustably mounted on the barrier support 210 to create target zones 240.

Figure 8:
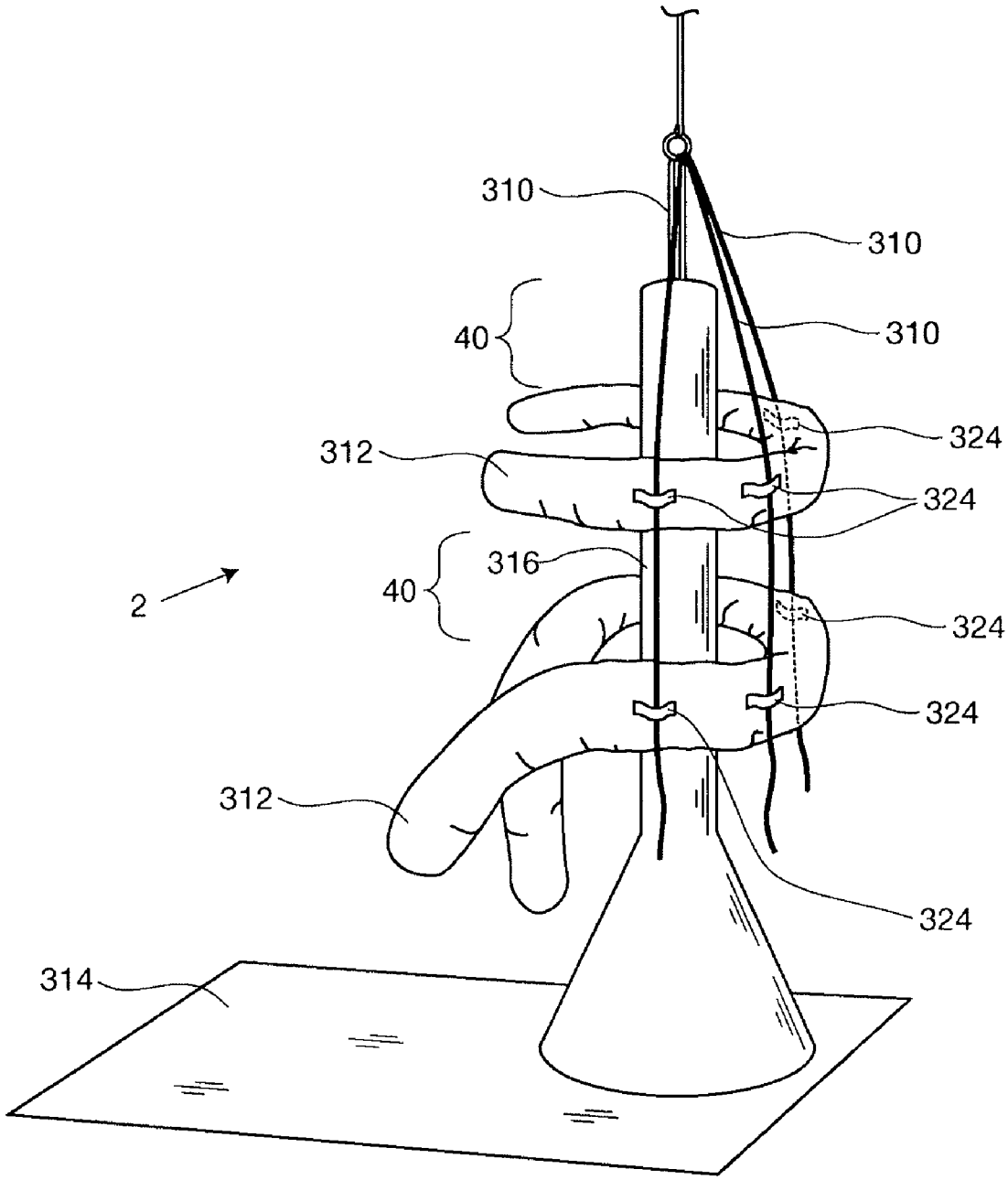
FIG. 8 is a perspective view of a martial arts training device in accordance with still yet another embodiment of the present invention.

FIG. 8 shows a view of another embodiment of the device 2 of the present invention. The target 316 is an upright target resting on the ground 314. The target 316 is surrounded by barriers 312 adjustably mounted to the barrier support 310. In this embodiment, the barriers 312 have irregular shapes and define various target zones 40. The barrier support 310 suspends from above, for example, from the ceiling, and could be constructed of rope, cord, or chain, for example. The barriers 312 attach to the barrier support 310 at barrier-attachments 324.

Certain modifications and improvements will occur to those skilled in the art upon a reading of the foregoing description. It should be understood that all such modifications and improvements have been deleted herein for the sake of conciseness and readability but are properly within the scope of the following claims.

What is claimed is:

1. A martial arts training device for use with a target, the device comprising:

a target for martial arts training and striking;

a substantially vertical barrier support having a base at its lower portion configured to support said device, wherein the barrier support includes a substantially uniform portion configured to allow the mating of at least one barrier attachment at numerous positions along the entire length of the uniform portion of the barrier support, wherein each of the at least one barrier attachments encircle and mate with the barrier support and are selectively adjustably slidable along the outside of the barrier support;

at least two rigid barriers being substantially horizontally oriented-with respect to the barrier support, wherein each of the at least two barriers includes a generally uniform cylindrical band along an entire length of each barrier for encircling the target;

said device creating an adjustable target zone encircling the target that is configured to adjust independently of the target; wherein the barrier support includes an upper portion having an extension arm extending horizontally from the vertical barrier support; and wherein the extension arm is for connecting to the target.

2. The martial arts training device according to claim 1, wherein the extension arm is for suspending the target.

3. The martial arts training device according to claim 1, wherein the base is for connecting to the target.

4. The martial arts training device according to claim 1, wherein the base is for supporting the target.

5. The martial arts training device according to claim 1, including a third barrier adjustably mounted to the barrier support.

6. The martial arts training device according to claim 1, wherein each barrier is covered in a jacket.

7. The device of claim 1, wherein the target zone is substantially horizontally adjacent to the target.

8. A martial arts training device comprising:

a target for martial arts training and striking;

a substantially vertical barrier support having a base at its lower portion configured to support said device, wherein the barrier support includes a substantially uniform portion configured to allow the mating of at least one barrier attachment at numerous positions along the uniform portion of the barrier support, wherein each of the at least one barrier attachments encircle and mate with the barrier support and are selectively slidably mounted along the outside of the barrier support and thereby movable relative to the target;

at least two rigid barriers mounted to the barrier support for creating a target zone, wherein the two barriers are substantially horizontally oriented with respect to the barrier support, and wherein each of the at least two barriers includes a generally uniform cylindrical band along an entire length of each barrier for encircling the target;

the target located within the target zone defined by the barriers.

9. The marital arts training device of claim 8, wherein the target is rigid.

10. The marital arts training device of claim 9, wherein the target is a post.

11. The marital arts training device of claim 8, wherein the target is elastic.

12. The martial arts training device of claim 11, wherein the target is a spring.

13. The martial arts training device of claim 12, wherein the spring is covered in a jacket.

14. The martial arts training device of claim 8, wherein the target is a bag containing a filling material.

15. The martial arts training device according to claim 8, wherein the target is supported by a floor.

16. The martial arts training device according to claim 8, wherein the target is attached to a wall.

17. The martial arts training device according to claim 8, wherein the target is suspended from a ceiling.

18. The martial arts training device of claim 8, further including a third barrier adjustable relative to the target.

19. The martial arts training device according to claim 8, wherein the barrier support includes an upper portion having an extension arm.

20. The martial arts training device according to claim 19, wherein the extension arm is for connecting to a target.

21. The martial arts training device according to claim 19, wherein the extension arm is for suspending a target.

22. The martial arts training device according to claim 8, wherein the base is for connecting to a target.

23. The martial arts training device according to claim 8, wherein the base is for supporting a target.

24. The martial arts training device according to claim 8, wherein at least one of the barriers is covered in a jacket.

25. The device of claim 8, wherein the target zone is substantially horizontally adjacent to the target.

26. A method of martial arts training, said method comprising the steps of:

placing a training accessory comprising a substantially freestanding barrier support, at least two barriers each comprising a generally uniform cylindrical band along an entire length of each barrier and being slidably attached to the barrier support to adjust independently of a target to create a first target zone, and a target encircled by the barriers;

striking the target in the first target zone between the encircling barriers;

moving at least one of the two barriers vertically along the barrier support to create a second target zone; and striking the target in the second target zone between the encircling barriers.

27. The method according to claim 26, wherein the training accessory further includes a base attached to the barrier support, the target is attached to the base and the barrier support.

* * * * *